US006021972A

United States Patent [19]

Inoue et al.

[11] Patent Number: 6,021,972

[45] Date of Patent: Feb. 8, 2000

[54] SHEET MATERIAL WINDING CORE

[75] Inventors: Yuji Inoue; Yasuhiko Kachi; Toshiya Kojima, all of Kanagawa, Japan

[73] Assignee: Fuji Photo Film Co., Ltd., Kanagawa, Japan

[21] Appl. No.: 09/189,936

[22] Filed: Nov. 12, 1998

[30] Foreign Application Priority Data

Nov. 13, 1997 [JP] Japan ..... 9-311993

[51] Int. Cl.[7] ..... B65H 75/24

[52] U.S. Cl. ..... 242/575.3; 242/532.3; 242/533; 242/548.2; 242/579; 242/583; 242/615.3

[58] Field of Search ..... 242/575.3, 532.3, 242/579, 548.2, 532.7, 532.4, 615.3, 583, 533

[56] References Cited

U.S. PATENT DOCUMENTS

| | | | |
|---|---|---|---|
| 1,115,057 | 10/1914 | Delaney | 242/575.3 |
| 1,135,388 | 4/1915 | Miser | 242/575.3 |
| 1,530,991 | 3/1925 | Forbes | 242/575.3 |
| 1,885,192 | 11/1932 | Elssner et al. | 242/575.3 |
| 2,765,125 | 10/1956 | Schlesinger | 242/575.3 |
| 3,662,968 | 5/1972 | Wennerberg | 242/548.2 |
| 3,667,696 | 6/1972 | McCarthy | 242/575.3 |
| 4,334,652 | 6/1982 | Blackburn | 242/575.3 |
| 4,422,586 | 12/1983 | Tetro | 242/532.3 X |
| 5,360,152 | 11/1994 | Matoushek | 242/615.3 X |
| 5,490,640 | 2/1996 | Miller et al. | 242/575.3 X |

FOREIGN PATENT DOCUMENTS

| | | | |
|---|---|---|---|
| 669693 | 1/1939 | Germany | 242/575.3 |
| 401069469 | 3/1989 | Japan | 242/532.3 |
| 530480 | 12/1940 | United Kingdom | 242/575.3 |

*Primary Examiner*—Donald P. Walsh
*Assistant Examiner*—Minh-Chau Pham
*Attorney, Agent, or Firm*—Sughrue, Mion, Zinn, MacPeak & Seas, PLLC

[57] ABSTRACT

A winding core member of a winding core is divided along an axial direction into a first main body, a second main body and a third main body. Projections which are formed at the respective main bodies can fit into cam grooves of cams provided in the winding core member. For this reason, when the cams are rotated, inner peripheral walls of the cam grooves are engaged with the projections, and the main bodies are pulled in inwardly in a radial direction so as to approach each other, so that an outer diameter of the winding core is decreased. Therefore, after a sheet material is or sheet materials are wound in layers around an outer periphery of the winding core, the winding core can be pulled out from the sheet material(s) easily.

24 Claims, 13 Drawing Sheets

SHEET MATERIAL WINDING CORE

BACKGROUND OF THE INVENTION

1. Field of the Invention

The present invention relates to a sheet material winding core for winding a sheet material or sheet materials, such as photosensitive material(s) or image receiving material(s), around an outer periphery thereof. (Herein, "sheet material" is intended to mean both plural sheet materials and a single, continuous sheet material.)

2. Description of the Related Art

An image recording apparatus, which records images by using image recording materials such as photosensitive materials and image receiving materials, is known.

In such an image recording apparatus, the photosensitive material and the image receiving material are wound in roll form and housed in magazines whose interiors are shielded from light. The material is nipped by drawing-out rollers and drawn out successively each time an image recording process is performed. Moreover, an exposure section, for exposing an image onto the photosensitive material, and a water applying section, for applying an image forming solvent onto the photosensitive material on which the image was exposed, are provided in the image recording apparatus. Further, a thermal development transfer section is provided next to the water applying section. Moreover, a plurality of guide plates and transport rollers are provided between the exposure section, the water applying section and the thermal development transfer section so as to interconnect the respective sections.

While the photosensitive material, which has been drawn-out from the magazine and cut to a predetermined length, is nipped and conveyed by the transport rollers, an image is exposed thereon. Then, water, which serves as an image forming solvent, is applied onto the photosensitive material in the water-applying section. Thereafter, the photosensitive material is conveyed into the thermal development transfer section. On the other hand, the image receiving material is drawn out of the magazine to a predetermined length and is cut in a manner similar to the photosensitive material, and is transported by the transport rollers into the thermal development transfer section synchronously with the photosensitive material. In the thermal development transfer section, the photosensitive material to which water was applied and the image receiving material are superposed together. While the photosensitive material and the image receiving material are being conveyed in this state, the photosensitive material is thermally developed and the image is transferred onto the image receiving material. As a result, a predetermined image is formed (recorded) on the image receiving material. Thereafter, the photosensitive material is separated from the image receiving material, and the image receiving material on which the image was recorded is taken out of the apparatus.

In such a conventional image recording apparatus, since the photosensitive materials separated from the image receiving materials as mentioned above are disposed of, the photosensitive materials should be collected. A structure has been conceived in which the photosensitive materials, which were separated from the image receiving materials, are successively wound around an outer periphery of a pipe-shaped winding core so as to be collected.

When the photosensitive materials are wound around such a winding core so as to be collected, they can be collected efficiently in a small space. Moreover, after the photosensitive materials, which were coated with water, are heated and are separated from the image receiving materials, the photosensitive materials may curl. However, when the photosensitive materials are wound around the winding core, they can be collected regardless of whether they curl. Thus, there is no need for countermeasures such as providing a presser plate for preventing curling, or corrugating the photosensitive material itself in order to improve the stiffness thereof, or the like, thereby simplifying the structure and lowering the cost.

After the sheet materials such as photosensitive materials are wound around the winding core so as to be collected in the aforementioned manner, needless to say, it is necessary to separate the winding core from the sheet materials wound thereon.

However, after the sheet materials such as photosensitive materials have been wound in layers around the winding core in the aforementioned manner, it is difficult to separate (pull out) only the winding core from the sheet materials which were wound and closely layered thereon. Therefore, a countermeasure to overcome this drawback is desired.

SUMMARY OF THE INVENTION

The present invention has been achieved with such points in view, and an object of the present invention is to provide a sheet material winding core which not only winds and collects therearound a sheet material or sheet materials, such as photosensitive materials or image receiving materials, but also from which the wound sheet material (s) can be separated easily without effort and time, and which can be realized by a simple structure.

In order to achieve the above object, a sheet material winding core according to the present invention comprises: a winding core member which is formed substantially cylindrically on the whole, and is formed by being divided along an axial direction into three or more main bodies, the main bodies being able to approach and move away from each other in a radial direction, said winding core member winding a sheet material or sheet materials around an outer periphery thereof; and an outer diameter increasing/decreasing mechanism provided within said winding core member, said mechanism allowing the main bodies to approach and move away from each other in the radial direction so as to increase and decrease an outer diameter of said winding core member.

In the sheet material winding core according to the present invention, the winding core member is formed by the three or more divisional main bodies, and the sheet materials are successively wound in layers around the outer periphery of the winding core member (the divisional main bodies).

Here, when, after the sheet materials are wound in layers around the winding core member, the winding core member is separated (pulled out) from the sheet materials wound in layers, the outer diameter increasing/decreasing mechanism is operated so that the three or more divisional main bodies approach each other in the radial direction so that the outer diameter of the winding core member is decreased. As a result, the winding core member can be easily separated from the sheet materials wound in layers closely thereon.

In this way, the sheet materials such as photosensitive materials or image receiving materials can be wound and collected, and also, the winding core member can be easily separated from the wound sheet materials without effort and time. Moreover, since the winding core member is formed so as to be divided into three or more parts along the axial direction of the winding core member, the entire periphery thereof can be increased and decreased to a large degree with respect to the wound sheet materials, so that the winding core member can be reliably separated from the sheet materials wound in layers closely thereon.

A sheet material winding core according to the present invention is characterized by further comprising a plurality of peeling members which are provided within the winding core member and project outward from surfaces of the main bodies in a state in which the outer diameter of the winding core member is decreased.

In this sheet material winding core, in the state in which the outer diameter of the winding core member is decreased, namely, when the outer diameter of the winding core member is decreased in order to separate (pull out) the winding core member from the sheet materials after the sheet materials have been wound in layers around the winding core member, the plural peeling members project outward from the surfaces of the main bodies. For this reason, even if the outer diameter of the winding core member is decreased and the sheet materials attempt to closely contact the surface of the winding core member, the sheet materials can be peeled forcibly from the surface of the winding core member (main bodies), and the winding core member can be more reliably separated from the sheet materials closely wound thereon.

The peeling members may be pin-shaped peeling pins, pipe-shaped peeling pieces, plate-spring-shaped peeling springs, or the like.

A sheet material winding core according to the present invention is characterized by further comprising stopper members for preventing deviative winding of the sheet materials along the axial direction of the winding core member, the stopper members being mounted to the surfaces of the main bodies so as to correspond to transverse direction edges of the sheet materials wound around the outer periphery of the winding core member.

In this sheet material winding core, in a case in which the sheet materials are successively wound in layers around the outer periphery of the winding core member (main bodies), the stopper members engage the transverse direction edges of the sheet materials, and as a result, deviative winding of the sheet materials along the axial direction of the winding core member is prevented. Therefore, the sheet materials can be more uniformly (efficiently) wound around the outer periphery of the winding core member (main bodies). For this reason, the winding core member can be more easily separated from the sheet materials closely wound in layers thereon.

In the sheet material winding core of the present invention, preferably, the stopper members are two or more pairs of stopper pieces, each of said pairs of stopper pieces being disposed on respectively different lines which run along a peripheral direction of the winding core member.

In this sheet material winding core, one pair of stopper rubbers may correspond to sheet materials which are, for example, A3-size, A4-size, 10×12 inch size, or 8×10 inch size. Another pair of stopper rubbers may correspond to sheet materials which are, for example, 2L-size or postcard-size. In this way, when sheet materials of respective sizes are wound on the outer periphery of the winding core member, even if the sizes of the wound sheet materials differ, deviative winding of the sheet materials along the axial direction of the winding core member is prevented.

In the sheet material winding core of the present invention, preferably, a sticking portion is provided at a surface of said main bodies so as to correspond to a leading end portion of a sheet material to be wound around the outer periphery of said winding core member, the leading end portion of the sheet material first sticking to said sticking portion.

In this sheet material winding core, because the leading end portion of the sheet material first sticks to the sticking portion provided at the surface of the main body, the sheet materials can be reliably wound onto the outer periphery of the winding core member.

In this case, the dimension of the sticking portion along the peripheral direction of the winding core member is in the range of from 1 mm to 40 mm, and is preferably 20 mm.

It is preferable that the sheet material winding core of the present invention is structured such that a phase plate for detection of a rotational position of said winding core member is provided at said winding core member, and due to detection of a position of said phase plate, rotation of said winding core member and advancing of the sheet material are synchronized such that the leading end portion of the sheet material sticks first to said sticking portion.

In this sheet material winding core, due to detection of the rotational position of the phase plate which is provided at the winding core member for detection of the rotational position of the winding core member, rotation of the winding core member and advancing of the sheet material are synchronized such that the leading end portion of the sheet material first sticks to the sticking portion. A rotatable circular plate of a rotary encoder may be used in place of the phase plate. The rotary encoder having a light source and a light detector can generate pulses in proportion to the rotation of the phase plate so that the rotation of the winding core can be synchronized with the advance of the sheet material. As a result, the sheet material is reliably wound onto the outer periphery of winding core member.

In the sheet material winding core of the present invention, it is preferable that a surface of said sticking portion is formed to have a surface roughness of $R_z=0.1\mu$ or less, and surfaces of said main bodies other than at said sticking portion are formed to have a surface roughness of $R_z=10\mu$ or more.

In this sheet material winding core, the surface of the sticking portion is formed to have a surface roughness of $R_z=0.1\mu$ or less (i.e., is formed as a mirror finished surface). Therefore, it is even easier for the leading end portion of the sheet material to stick to the sticking portion, and the sheet materials can be wound more reliably on the outer periphery of the winding core member. On the other hand, the surfaces of the main bodies at regions other than the sticking portion are formed so as to have a surface roughness of $R_z=10\mu$ or more. Therefore, at regions other than the region at which the sticking portion is formed, it is difficult for the sheet materials to closely contact the winding core member. The sheet materials can be easily peeled from the surface of the winding core member (the respective main bodies) , and the winding core member can be more reliably separated from the sheet materials closely wound thereon.

It is preferable that the outer diameter increasing/decreasing mechanism of sheet material winding core of the present invention include: a pair of substantially disk-shaped cams which are fixed to vicinities of both axial direction ends of a supporting shaft provided in a center portion in said winding core member and which have a plurality of cam grooves notched in the supporting shaft direction; projections which project from both axial direction ends of the main bodies and engage with the cam grooves; a first coil spring whose one end is anchored to the cam and whose other end is anchored to one of the main bodies; a second coil spring whose one end is anchored to the cam and whose other end is anchored to one of the other main bodies; a pair of guide members which are mounted to the supporting shaft at supporting shaft axial direction outer sides of the cams so as to be rotatable relatively to the supporting shaft, the guide members engaging with the main bodies; and a handle which is mounted to one end of the supporting shaft and is operated to rotate the cams. Accordingly, when the sheet materials are wound on the surface of the winding core member, the main bodies are urged in the directions of being spaced apart from each other due to the urging force of the first and second coil springs. When the sheet materials are to be removed from the winding core, the handle is turned against the urging force of the first and second coil springs so as to bring the main bodies close to each other (i.e., such that the main bodies move toward the supporting shaft), so as to decrease the diameter of the winding core member. Therefore, the sheet materials can be reliably separated from the surface of the winding core.

DESCRIPTION OF THE PREFERRED EMBODIMENT

A preferred embodiment of the present invention will be described here in after with reference to the drawings.

Figure 10:
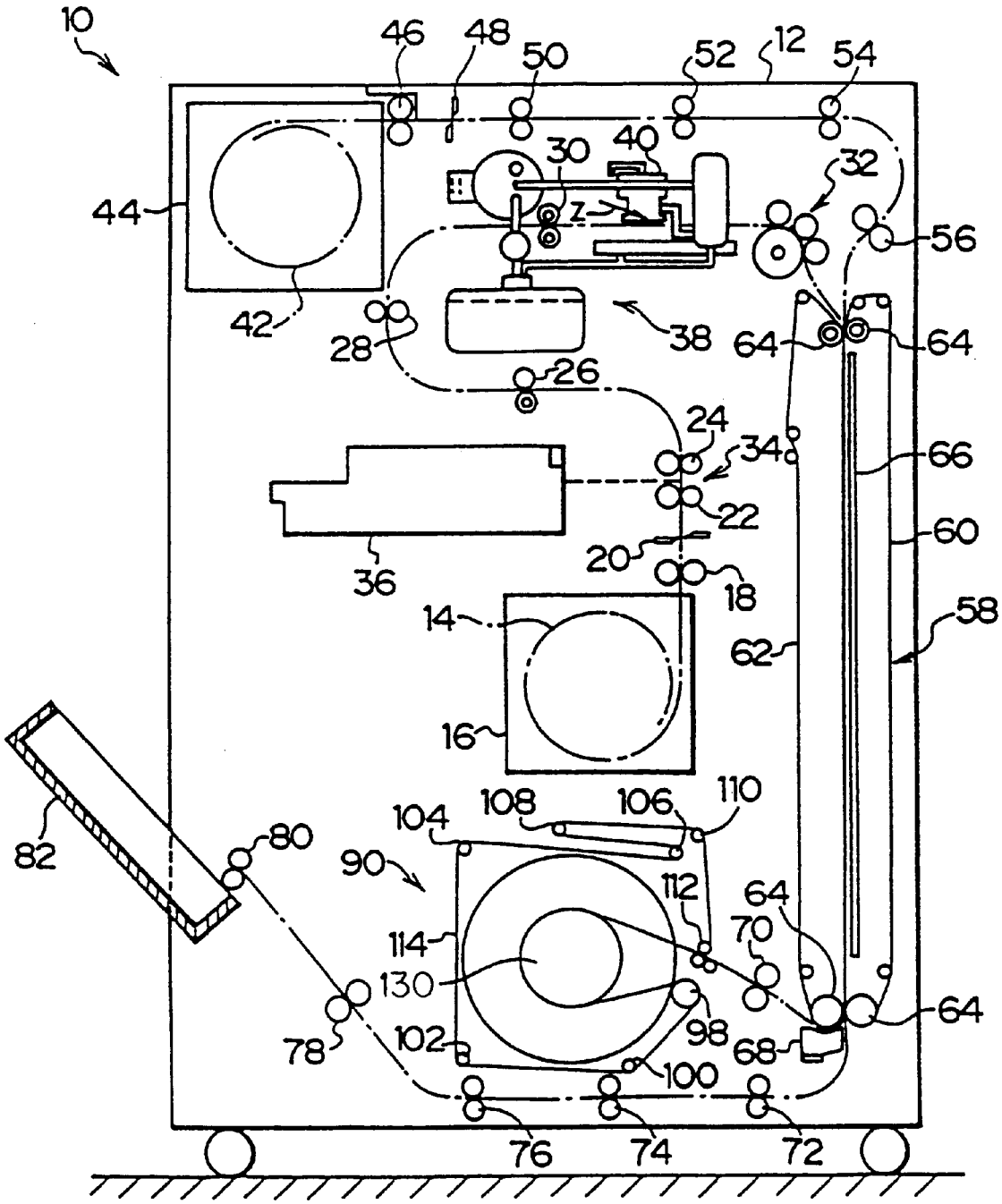
FIG. 10 is an overall structural view of an image recording apparatus to which the winding core according to the embodiment of the present invention is applied.

FIG. 10 shows the overall structure of an image recording apparatus 10 to which a sheet material winding core 130 according to an embodiment of the present invention is applied.

The image recording apparatus 10 has a frame 12. A photosensitive material magazine 16 for housing a photosensitive material 14 as an image forming sheet material is provided within the frame 12. The photosensitive material 14 is wound in the photosensitive material magazine 16 in roll form so that a photosensitive (exposure) surface of the photosensitive material 14 drawn out of the photosensitive material magazine 16 faces toward the left in FIG. 10.

A nip roller 18 and a cutter 20 are disposed in the vicinity of a photosensitive material removal opening of the photosensitive material magazine 16, such that after the photosensitive material 14 is drawn out of the photosensitive material magazine 16 to a predetermined length, the photosensitive material 14 can be cut.

A plurality of transport rollers 22, 24, 26, 28, 30 and 32 are disposed in that order above the cutter 20, and guide plates (not shown) are provided between the respective transport rollers. The space between the transport rollers 22 and the transport rollers 24 is an exposure section 34. The photosensitive material 14, which has been cut to the predetermined length, is transported to the exposure section 34.

A laser beam emitting section 36 is provided at the left side of the exposure section 34. A semiconductor laser (not shown) is provided in the laser beam emitting portion 36, and the semiconductor laser emits beams of red, green and blue laser light so as to expose the photosensitive material 14 in the exposure section 34.

Further, a water applying section 38 for applying an image forming solvent is provided above the exposure section 34. The photosensitive material 14, which was drawn out of the photosensitive material magazine 16 and was exposed in the exposure section 34, is nipped and conveyed by the transport rollers 26, 28, so as to be fed into the water applying section 38. A jet tank 40 is provided in the water applying section 38, and water is jetted from the jet tank 40 at the position represented by arrow Z so that water can be applied to the photosensitive material 14.

A receiving material magazine 44 for housing an image receiving material 42 is provided at an upper-left hand region within the frame 12 in FIG. 10. An image forming surface of the image receiving material 42 is coated with a dye fixing material having mordant. The image receiving material 42 is wound in the receiving material magazine 44 in roll form so that the image forming surface of the image receiving material 42 drawn out of the receiving material magazine 44 faces downward.

A nip roller 46 and a cutter 48 are provided in the vicinity of an image receiving material removal opening of the receiving material magazine 44. After the image receiving material 42 is drawn out of the receiving material magazine 44 to a predetermined length, the image receiving material 42 can be cut. In this case, the image receiving material 42 is cut so as to be shorter than the photosensitive material 14.

Transport rollers 50, 52, 54 and 56 and guide plates (not shown) are provided at a side of the cutter 48 so that the image receiving material 42 which was cut to the predetermined length can be transported to a thermal development transfer section 58.

A pair of endless belts 60 and 62, whose longitudinal direction is the vertical direction, are provided in the thermal development transfer section 58. These endless belts 60 and 62 are trained respectively around a plurality of training rollers 64, and the inner sides of their loops are tightly pressed against each other. The endless belts 60 and 62 are rotated by rotational driving of at least one of the training rollers 64.

Therefore, the photosensitive material 14 is fed between the pair of endless belts 60 and 62 in the thermal development transfer section 58 by the final transport roller 32 on the transport path. Moreover, the image receiving material 42 is transported synchronously with the transportation of the photosensitive material 14, and is fed between the pair of endless belts 60 and 62 in the thermal development transfer section 58 by the final transport roller 56 on the transport path with the photosensitive material 14 preceding by a predetermined length, so that the image receiving material 42 is overlapped with the photosensitive material 14.

Further, a heating plate 66, which is formed as a flat plate whose longitudinal direction is the vertical direction, is disposed within the loop of the one endless belt 60 so as to face the inner periphery of the endless belt 60 at the left side of FIG. 10. A linear heater (not shown) is disposed within the heating plate 66, and the surface of the heating plate 66 is heated by the heater to a predetermined temperature.

The photosensitive material 14 and the image receiving material 42, which are overlapped with each other by the pair of endless belts 60 and 62, are sandwiched between the pair of endless belts 60 and 62 so as to be transported in this overlapped state, and are heated by the heating plate 66 at this time. Accordingly, the photosensitive material 14 releases movable dyes, and simultaneously, the dyes are transferred onto the dye fixing layer of the image receiving material 42 so that an image can be formed on the image receiving material 42.

A peeling claw 68 is disposed at the material supplying direction downstream side of the thermal development transfer section 58 (endless belts 60 and 62). The peeling claw 68 engages with only the leading end portion of the photosensitive material 14, among the photosensitive material 14 and the image receiving material 42 which are being sandwiched and transported by the pair of endless belts 60 and 62, so as to peel the photosensitive material 14 from the image receiving material 42.

A photosensitive material discharge roller 70 is provided at the left side of the peeling claw 68 in FIG. 10, and transports the photosensitive material 14, which is being guided and transported by the peeling claw 68, to a collecting apparatus 90.

Furthermore, receiving material discharge rollers 72, 74, 76, 78 and 80 are disposed in that order at the left side of the peeling claw 68 in FIG. 10, and discharge the image receiving material 42, which was fed out from the pair of endless belts 60 and 62, onto a tray 82.

Figure 11:
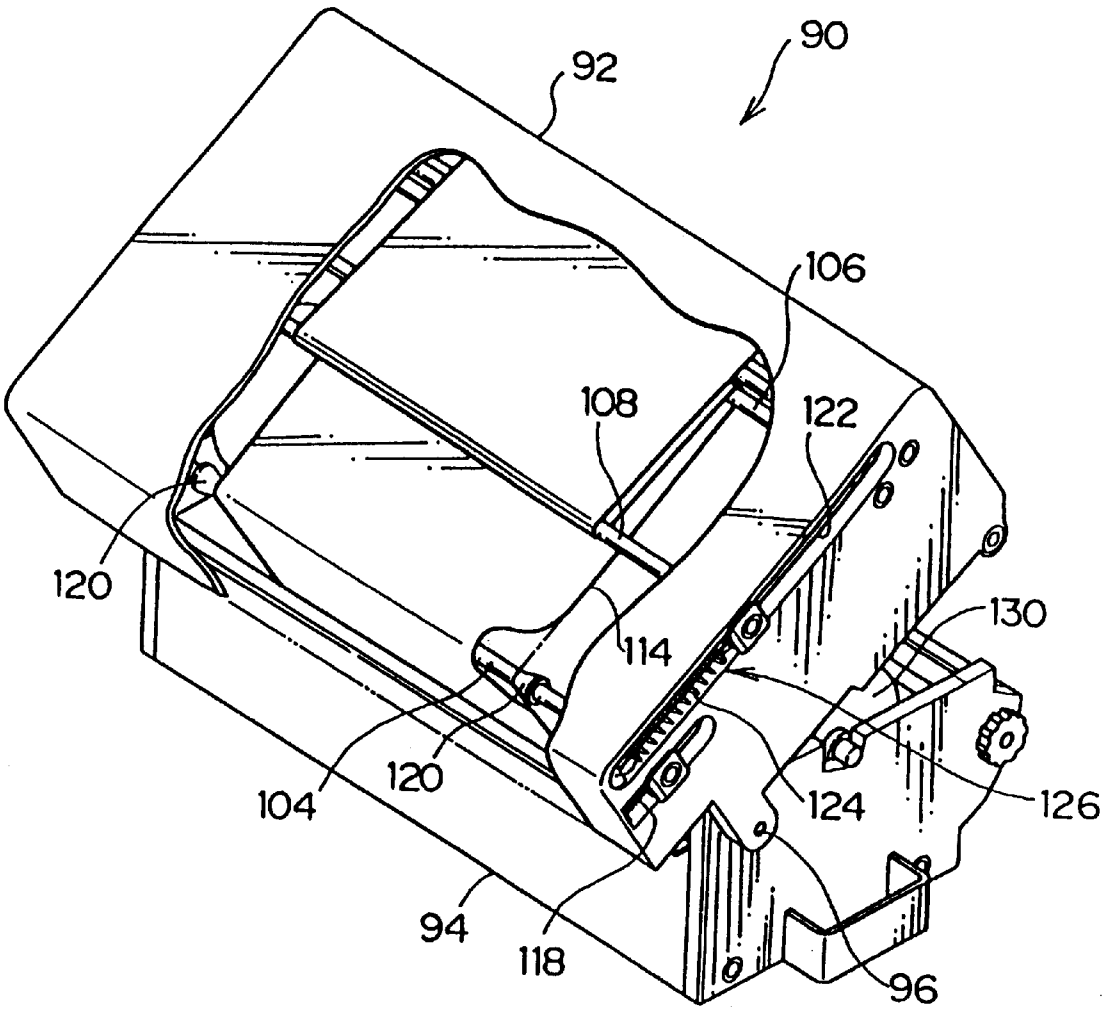
FIG. 11 is a perspective view showing a structure of a collecting apparatus to which the winding core according to the embodiment of the present invention is applied.
Figure 12:
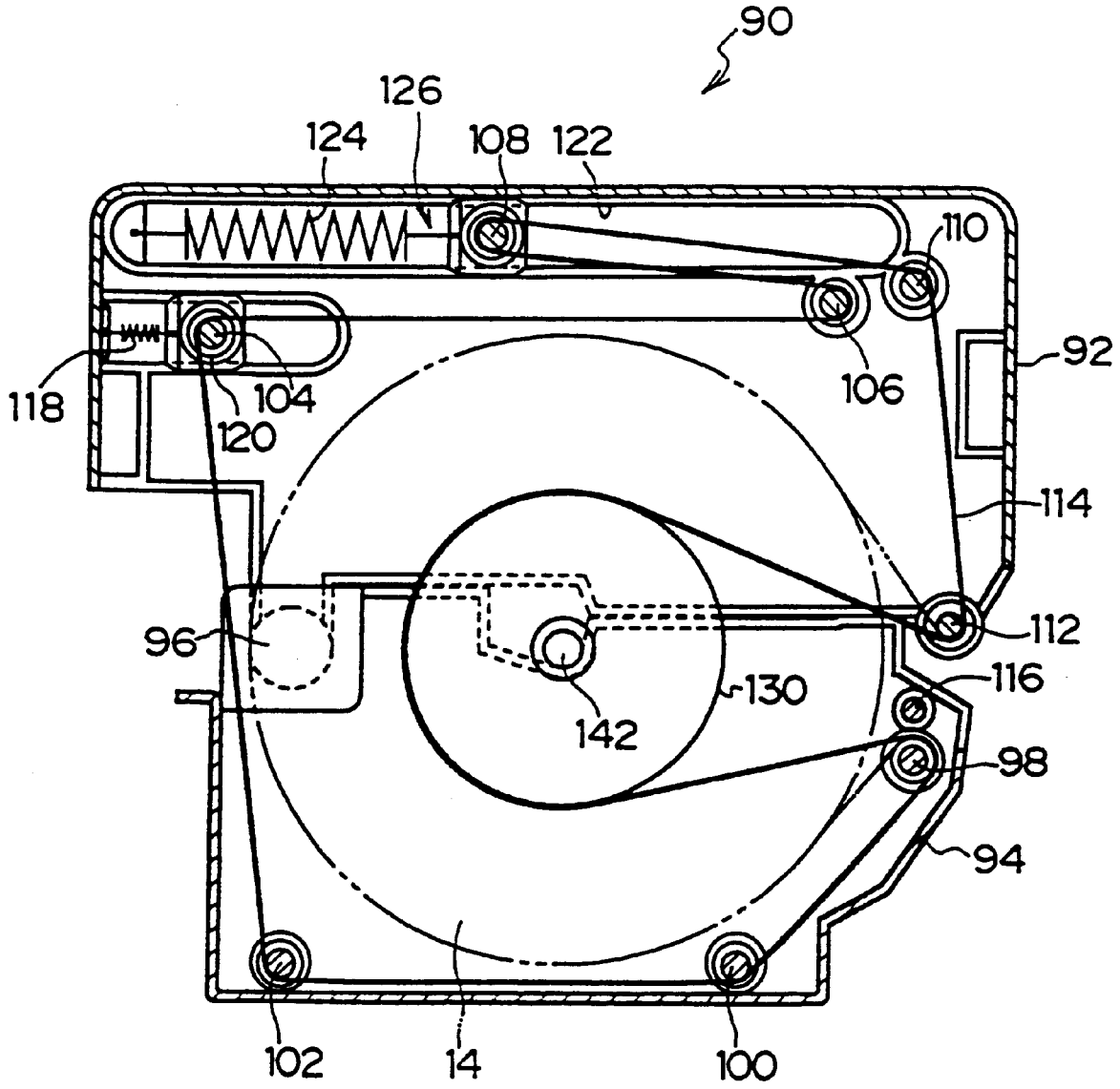
FIG. 12 is a sectional view showing the structure of the collecting apparatus to which the winding core according to the embodiment of the present invention is applied.

Here, in FIG. 11, the structure of the collecting apparatus 90 is shown in perspective view. Moreover, in FIGS. 12 and 13, the structure of the collecting apparatus 90 is shown in a sectional view.

The collecting apparatus 90 has an upper main body 92 and a lower main body 94. The upper main body 92 and the lower main body 94 are formed into a box shape. A lower end corner portion of the upper main body 92 is pivotably connected to an upper end corner portion of the lower main body 94 by a supporting shaft 96. For this reason, when the upper main body 92 is pivoted about the supporting shaft 96, the collecting apparatus 90 can be opened.

In addition, a winding core 130 and rollers 98, 100 and 102, which will be described later, are supported in the lower main body 94. Rollers 104, 106, 108, 110 and 112 are supported in the upper main body 92. Further, an endless belt 114 is trained around the winding core 130 and rollers 98, 100, 102, 104, 106, 108, 110 and 112. Namely, the endless belt 114 is trained around the respective rollers, and the outer side thereof tightly contacts the winding core 130.

A driving source, not shown, is connected to the roller 98 so that the roller 98 is a driving roller. Moreover, a guide roller 116 is provided directly above the roller 98. For this reason, when the roller 98 is rotated, the endless belt 114 and the guide roller 116 are rotated, and accordingly, the winding core 130 is also rotated.

As a result, the photosensitive material 14, which was peeled from the image receiving material 42 by the peeling claw 68 and was fed out by the photosensitive material discharge roller 70, is guided to be supplied to between the endless belt 114 and the winding core 130 by the guide roller 116, and the photosensitive material 14 can be wound successively around the winding core 130 while being sandwiched between the endless belt 114 and the winding core 130.

In addition, the roller 104 is connected to a spring 118, and the spring 118 applies a predetermined tension to the endless belt 114. Moreover, a truncated cone-shaped guide portion 120 is provided on each axial direction end of the roller 104 to prevent axial direction displacement (shifting) of the endless belt 114.

Further, the roller 108 at the uppermost position can slide along a guide groove 122 provided in the upper main body 92, and is urged by a spring 124. Namely, the roller 108 and the spring 124 form a buffer portion 126 of the endless belt 114. When the wound diameter gradually increases due to winding of the photosensitive materials 14 around the winding core 130, the roller 108 moves (is displaced) along the guide groove 122 so that apparent increases and decreases in the trained length of the endless belt 114 can be absorbed.

Figure 1:
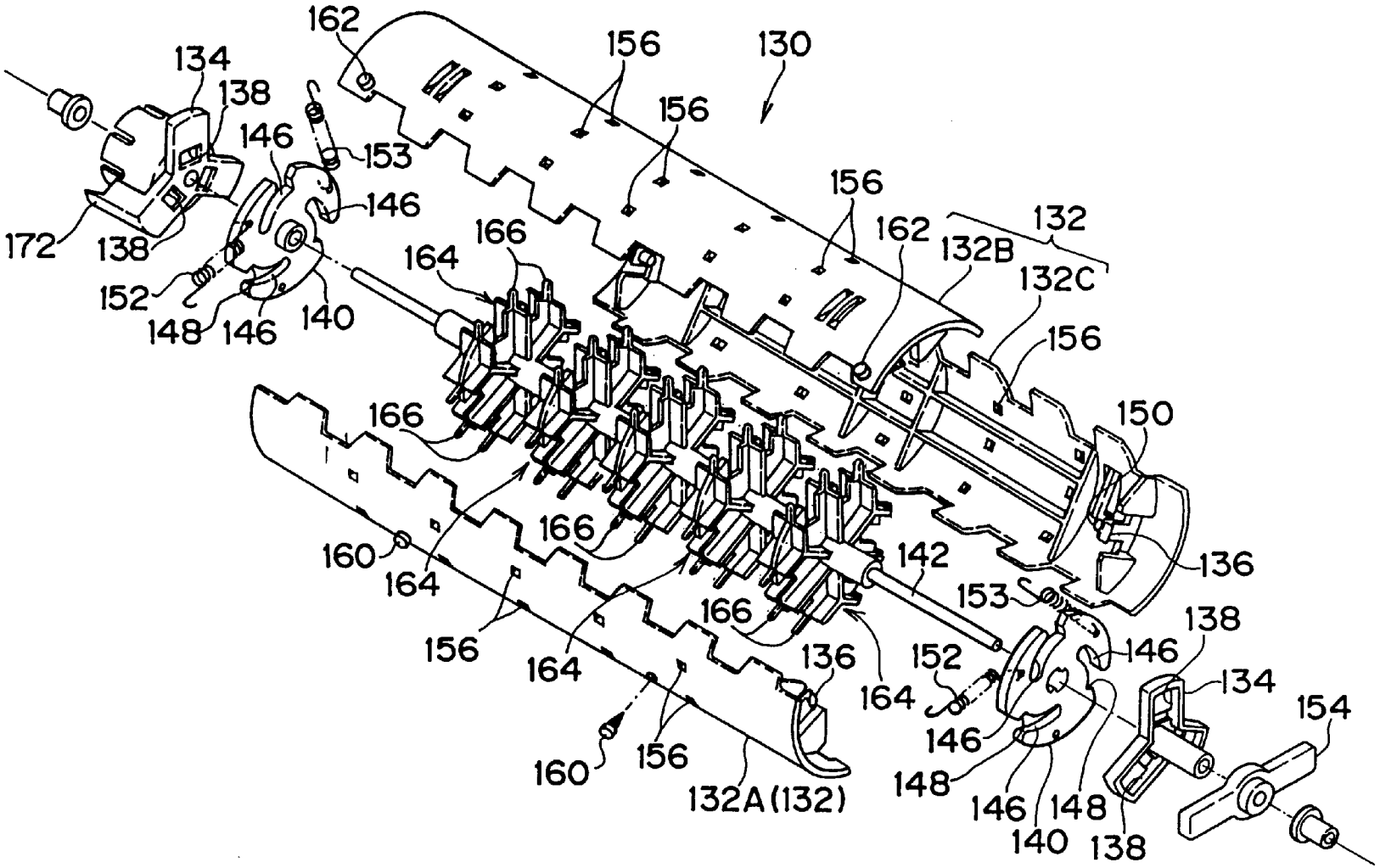
FIG. 1 is an exploded perspective view showing a structure of a winding core according to an embodiment of the present invention.
Figure 2:
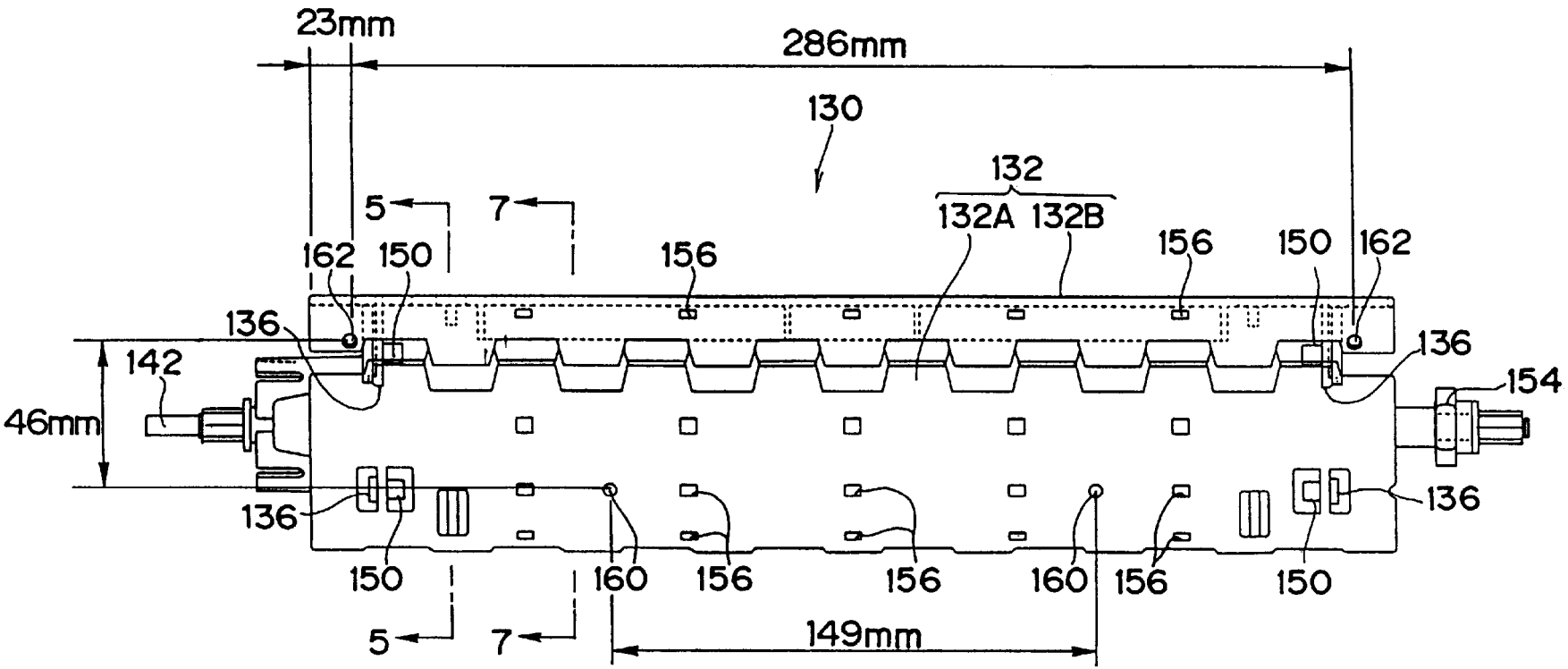
FIG. 2 is a front view showing the structure of the winding core according to the embodiment of the present invention.
Figure 3:
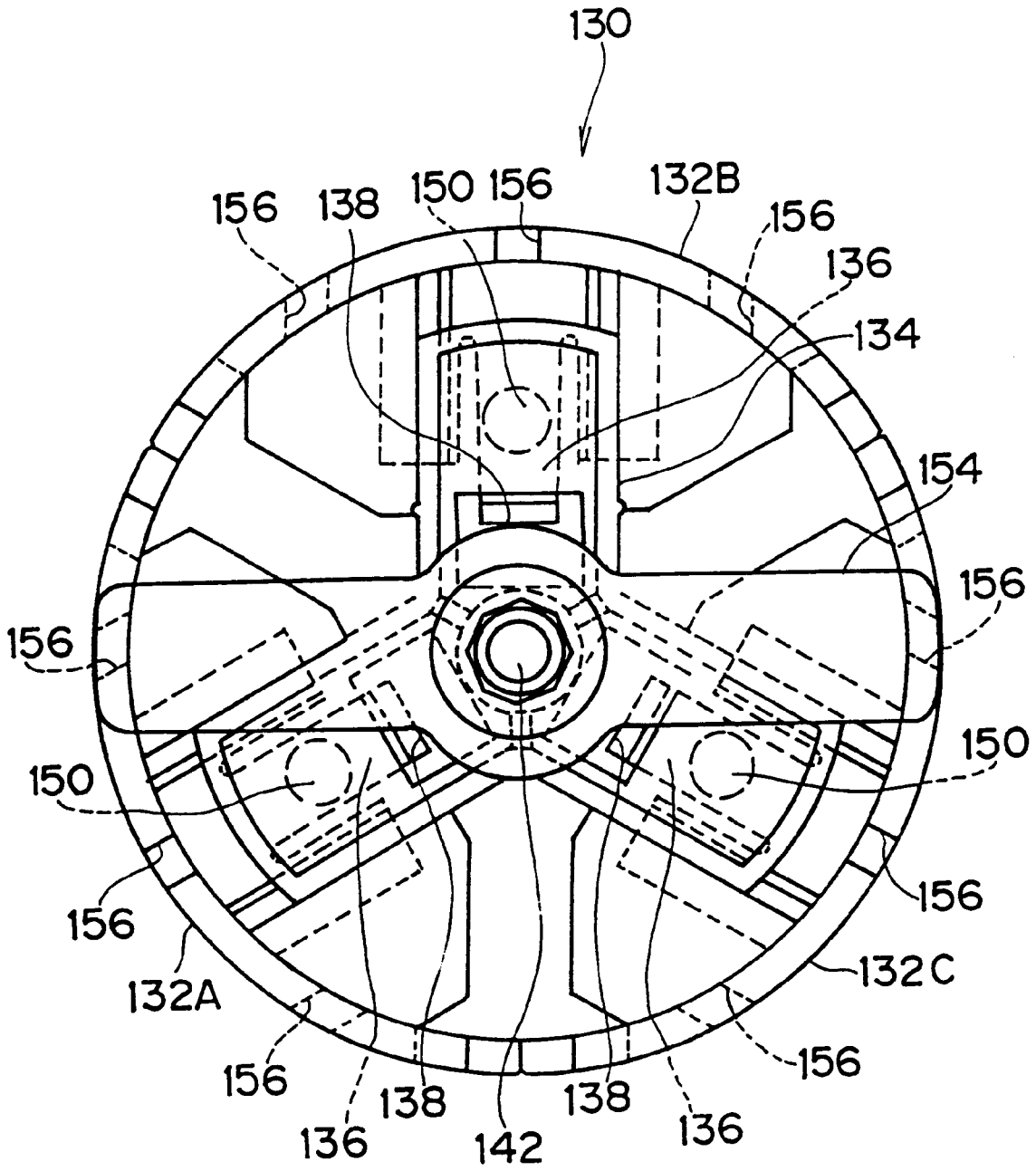
FIG. 3 is a side view showing the structure of the winding core according to the embodiment of the present invention.
Figure 4:
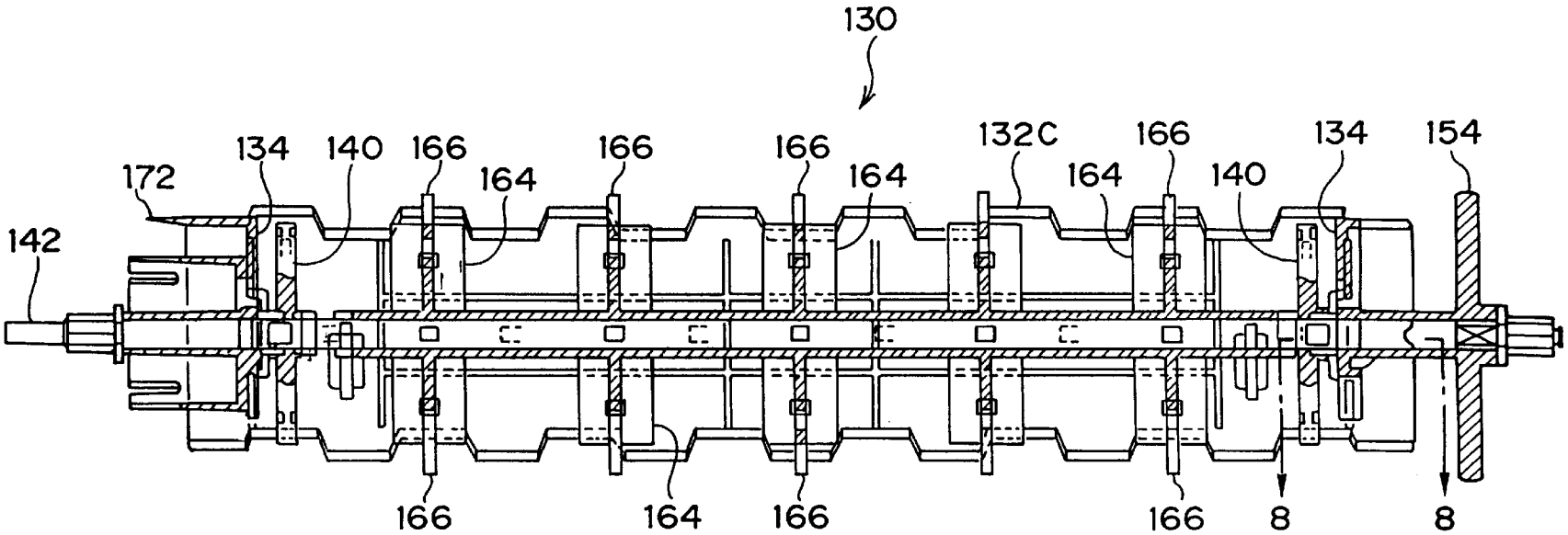
FIG. 4 is a longitudinal sectional view showing the structure of the winding core according to the embodiment of the present invention.
Figure 5:
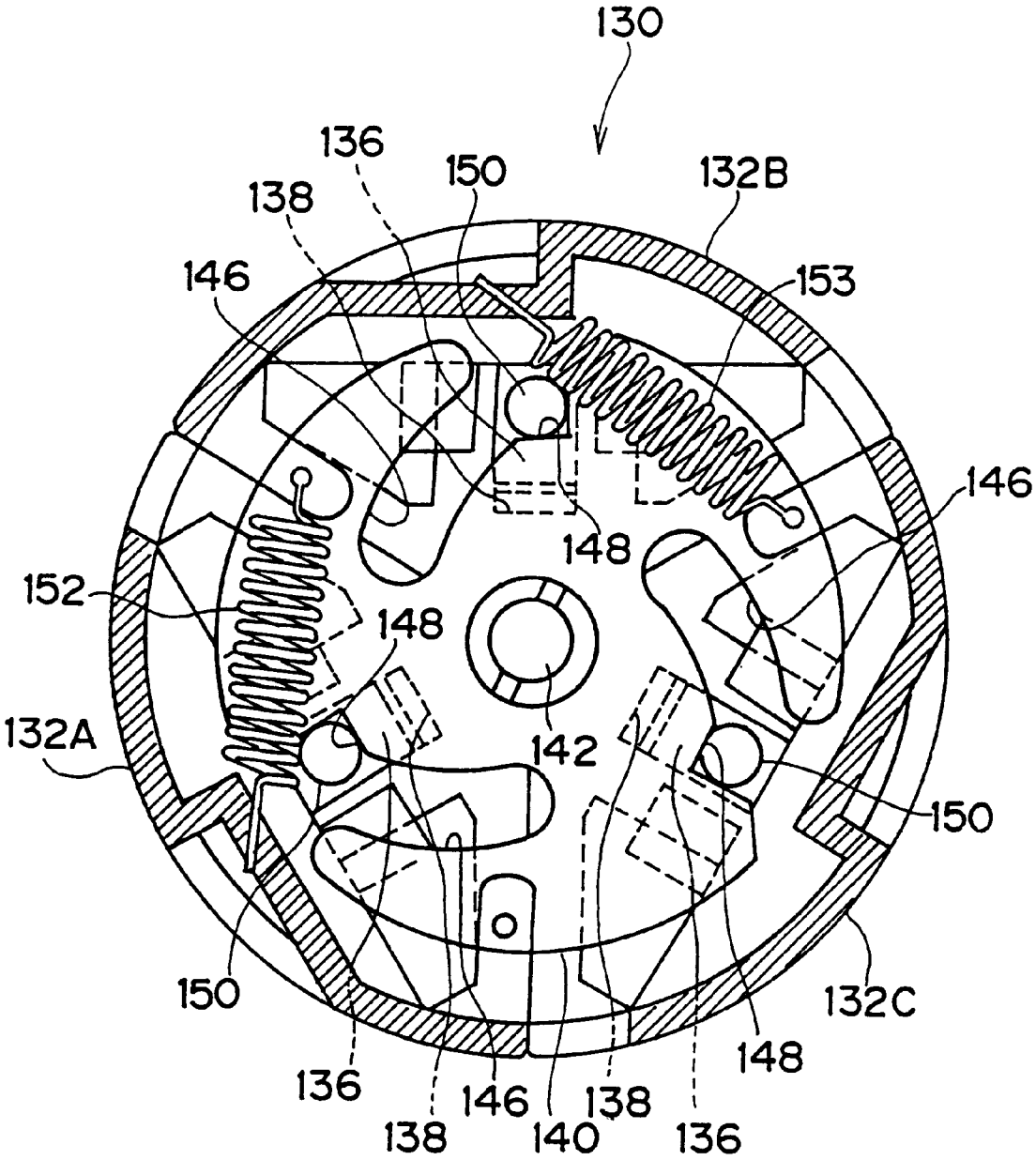
FIG. 5 is a sectional view taken along line 5—5 of FIG. 2 showing the structure of the winding core according to the embodiment of the present invention.
Figure 6:
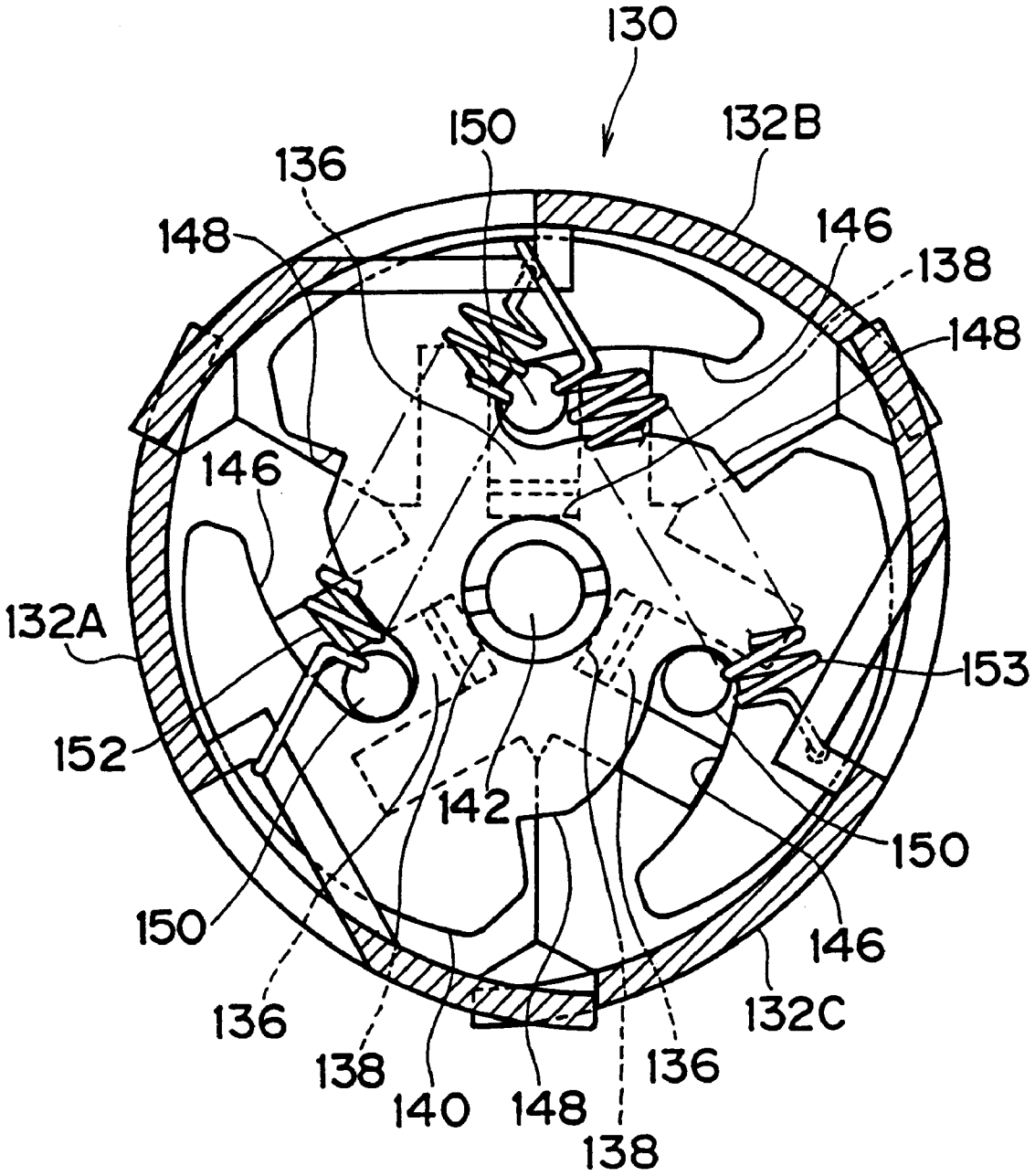
FIG. 6 is a sectional view corresponding to FIG. 5 and showing the structure of the winding core according to the embodiment of the present invention in which a diameter is decreased.
Figure 7:
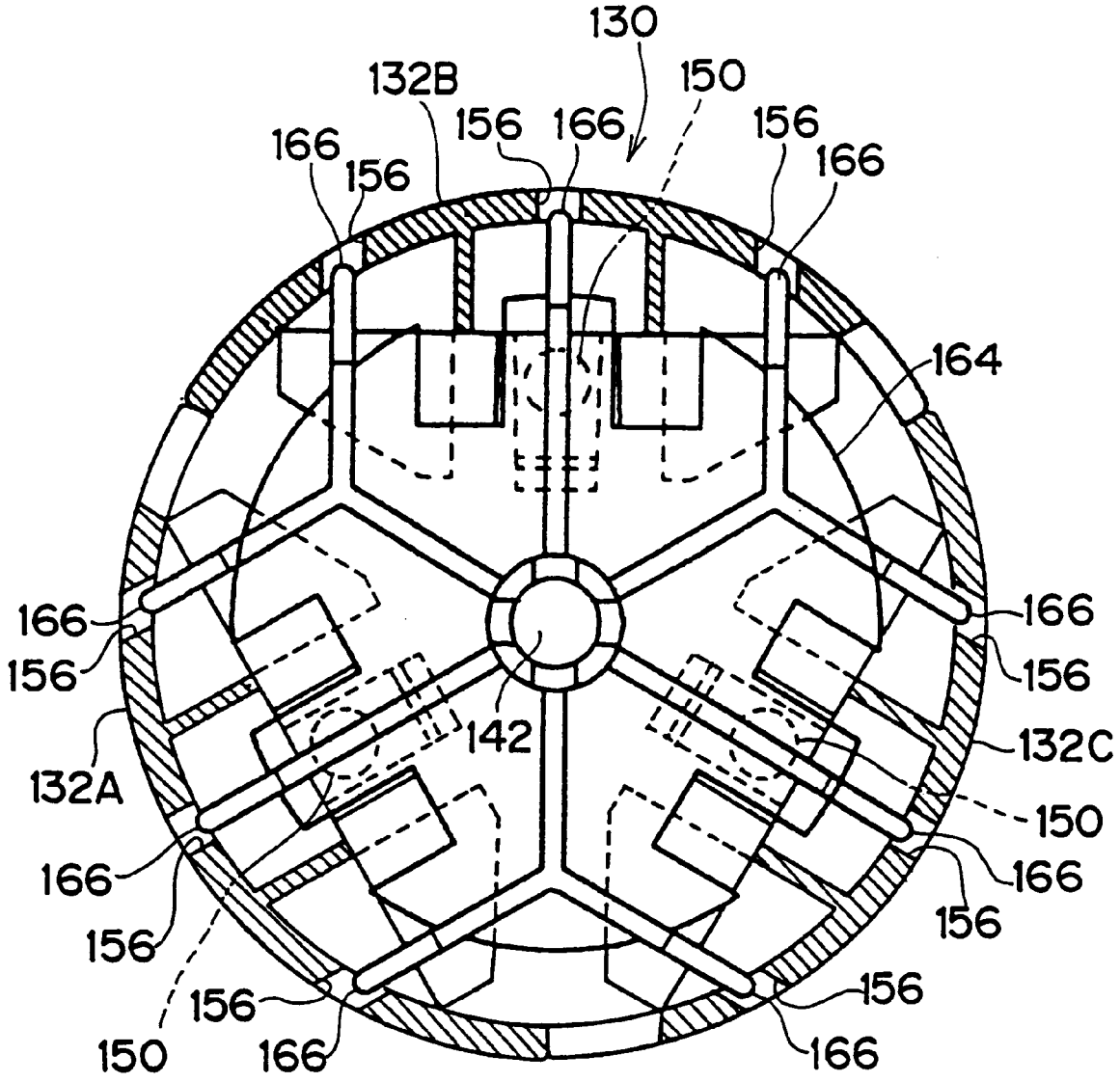
FIG. 7 is a sectional view taken along line 7—7 of FIG. 2 and showing the structure of the winding core according to the embodiment of the present invention.
Figure 8:
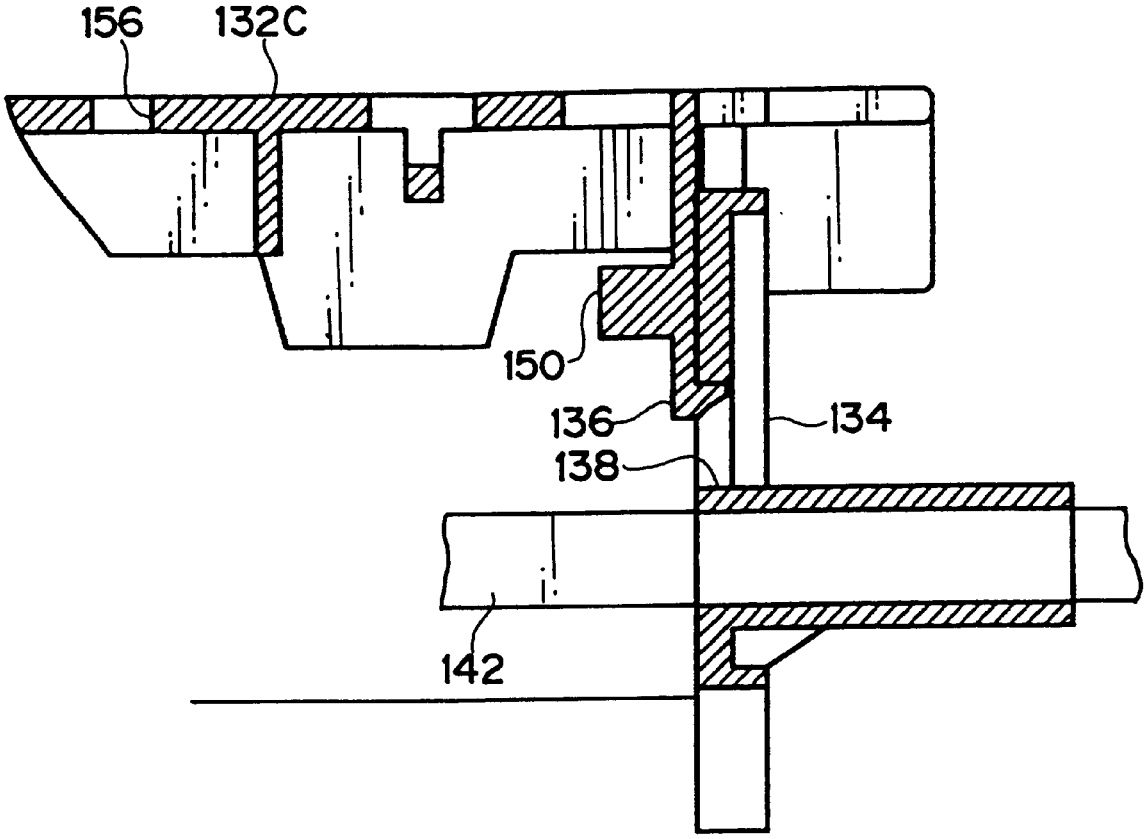
FIG. 8 is a sectional view taken along line 8—8 of FIG. 4 showing the structure of the winding core according to the embodiment of the present invention.

FIG. 1 is an exploded perspective view of the winding core 130. FIG. 2 is a front view of the winding core 130, and FIG. 3 is a side view of the winding core 130. Further, FIG. 4 is a longitudinal sectional view of the winding core 130, and FIGS. 5 through 7 are transverse sectional views of the winding core 130.

The winding core 130 has a winding core member 132 which is formed on the whole in a substantially cylindrical form. The winding core member 132 is formed by a first main body 132A, a second main body 132B and a third main body 132C. Claws 136 are projected in the radial direction from each of the axial direction ends of the first main body 132A, the second main body 132B and the third main body 132C.

In addition, a supporting shaft 142 is provided in a center portion of the winding core member 132 (first main body 132A, second main body 132B and third main body 132C). A pair of guide rails 134 are mounted to the supporting shaft 142 so as to be able to rotate relatively with respect to the supporting shaft 142. The guide rail 134 is formed so as to have three projected portions corresponding to the first main body 132A, the second main body 132B and the third main body 132C, and fitting holes 138 are formed correspondingly to the claws 136. The fitting holes 138 are formed so as to extended out radially from around the supporting axis 142 along the radial direction. When the claws 136 are fitted into the fitting holes 138, the first main body 132A, the second main body 132B and the third main body 132C are joined integrally so that the winding core member 132 whose overall shape is substantially cylindrical is formed.

In addition, a plurality of through-holes 156 are formed in the surface of the winding core member 132 (the first main body 132A, the second main body 132B and the third main body 132C) along the peripheral direction and the axial direction at prescribed intervals. The through-holes 156 are formed correspondingly to peeling pins 166 which serve as peeling members and will be described later.

Further, a pair of stopper rubbers 160 are mounted to the first main body 132A so as to be spaced apart by a predetermined interval, and a pair of stopper rubbers 162 are mounted to the second main body 132B so as to be spaced apart by a predetermined interval. As shown in FIG. 2, one group of stopper rubbers, i.e., the stopper rubbers 160, are positioned so as to be spaced apart from one another by 149 mm along the axial direction of the first main body 132A, and correspond to transverse direction edges of the photosensitive material 14 which is, for example, 2L-size or postcard-size and is to be wound around the outer periphery of the winding core member 132. The other stopper rubber group, i.e., the stopper rubbers 162, are positioned so as to be spaced apart from one another by 286 mm along the axial direction of the second main body 132B, and correspond to transverse direction edges of the photosensitive material 14 which is, for example, A3-size, A-4 size, 10×12 inch size,. or 8×10 inch size and is to be wound around the outer periphery of the winding core member 132. Moreover, the one group of stopper rubbers 160 and the other group off stopper rubbers 162 are positioned so as to be spaced apart from each other by 46 mm along the peripheral direction of the winding core member 132. As a result, when the photosensitive materials 14 of the respective sizes are wound around the outer periphery of the winding core member 132, the stopper rubbers 160 and 162 prevent deviative winding of the photosensitive materials 14, i.e., prevent the photosensitive materials 14 from shifting along the axial direction of the winding core member 132.

Figure 9:
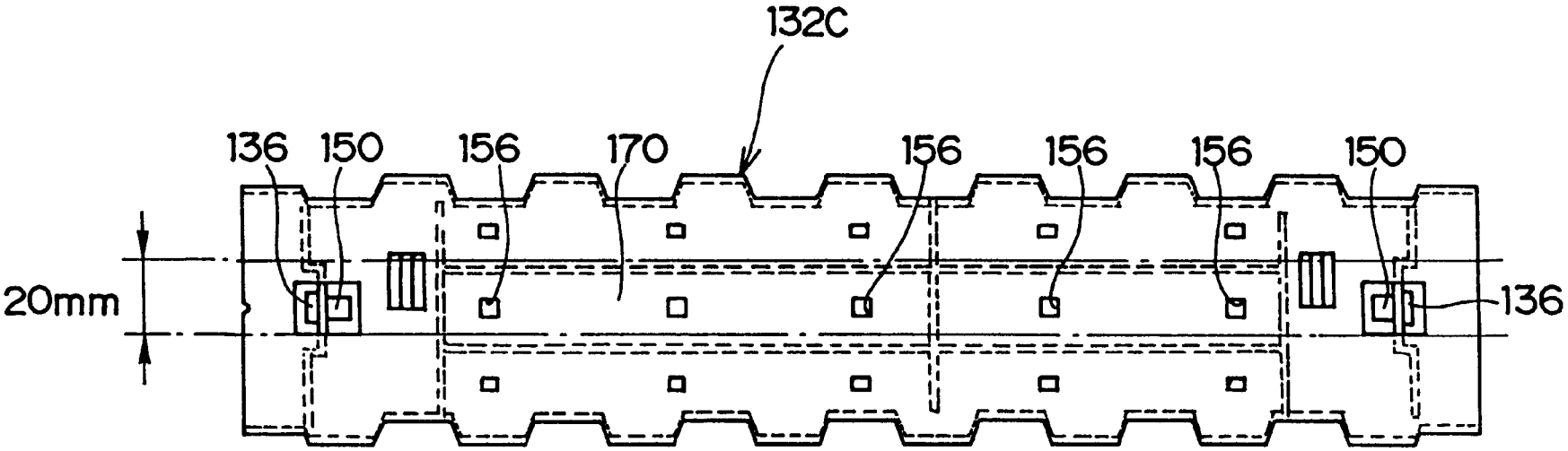
FIG. 9 is a plan view of a third main body and illustrates the structure of a sticking portion of the winding core according to the embodiment of the present invention.

As shown in FIG. 9, a sticking portion 170 is provided at the surface of the third main body 132C of the winding core member 132. The dimension of the sticking body 170 along the peripheral direction of the third main body 132C is 20 mm. The surface of the sticking portion 170 is formed to have a surface roughness of $R_z$=0.1$\mu$ or less. The leading end portion of the photosensitive material 14 which is to be wound around the outer periphery of the winding core member 132 first sticks to the sticking portion 170.

The surfaces of the portions of the winding core member 132 (the first main body 132A, the second main body 132B, and the third main body 132C) other than the sticking portion 170 are formed to a surface roughness of $R_z$=10$\mu$ or more.

A pair of cams 140 forming an outside diameter increasing/decreasing mechanism are housed in the winding core member 132 having the above structure (first main body 132A, second main body 132B and third main body 132C). As shown in detail in FIGS. 5 and 6, the cams 140 are formed so as to have a substantial disk shape, and are fixed integrally to the supporting shaft 142. As a result, the cams 140 are supported rotatably within the winding core member 132, and in this supported state, are positioned in the vicinities of the axial direction ends of the winding core member 132.

In addition, three cam grooves 146, which are opened to the outside peripheral edge, are formed in the cam 140. The cam grooves 146 are formed so as to be gradually notched from the outside peripheral edge of the cam 140 toward the center, and a holding portion 148 is formed at the end at the opening side. Projections 150, which are projected from the inner surfaces of both axial direction end walls of the first main body 132A, the second main body 132B and the third main body 132C, enter into the cam grooves 146. In this case, in the state in which the projections 150 are positioned in the holding portions 148 of the cam grooves 146 (FIG. 5), the projections 150, namely, the first main body 132A, the second main body 132B and the third main body 132C, are separated from the cams 140, namely, are separated from each other, and movement of the main bodies 132A, 132B, 132C in directions of approaching one another is limited. On the other hand, when the cams 140 are rotated together with the supporting shaft 142, the inner peripheral walls of the cam grooves 146 engage with the projections 150, and the projections 150, namely, the first main body 132A, the second main body 132B and the third main body 132C, can be pulled in (approach each other) (namely, can move towards the supporting shaft 142).

In addition, each cam 140 is connected with one end of a spring 152 and a spring 153. Further, the other end of the spring 152 is anchored to the first main body 132A, and the other end of the spring 153 is anchored to the second main body 132B. The springs 152 and 153 urge the cams 140 in a direction in which the projections 150 come out of the cam grooves 146. For this reason, normally, the projections 150 are positioned at the holding portions 148 of the cam grooves 146, and accordingly the first main body 132A, the second main body 132B and the third main body 132C are separated from each other (namely, from the supporting shaft 142), and movement thereof toward each other (namely, towards the supporting shaft 142) is limited.

One end of the supporting shaft 142 is projected further outwardly than a guide rail 134, and a handle 154 is mounted to its end. As a result, the supporting shaft 142, namely, the cams 140, can be rotated by operating the handle 154.

Furthermore, a plurality of spacers 164 are provided within the winding core member 132 (first main body 132A, second main body 132B and third main body 132C) . The spacers 164 are formed in substantially disk-shaped forms which correspond to the winding core member 132. The supporting shaft 142 is inserted through their shaft core portion so as to be rotatable relatively. The spacers 164 are provided along the axial direction of the supporting shaft 142 so as to be adjacent to each other and so as to be connected with each other integrally.

As shown in detail in FIG. 7, the peeling pins 166, which are projected in the radially outward direction, are formed on the outer periphery of the spacer 164. The peeling pins 166 are provided in correspondence with the aforementioned through-holes 156 of the winding core member 132, and can be fitted into the through-holes 156. Moreover, in this case, the peeling pins 166 are projected in directions in which the first main body 132A, the second main body 132B and the third main body 132C approach and move away from one another, i.e., in directions in which the outer diameter of the winding core member 132 increases and decreases (in other words, the directions along the fitting holes 138 of the guide rails 134).

The sizes of the respective portions are set such that, in the state in which the outer diameter of the winding core member 132 is decreased, the peeling pins 166 are inserted through the through-holes 156 so as to be projected outwardly from the surfaces of the first main body 132A, the second main body 132B and the third main body 132C.

A phase plate 172 (see FIG. 1), for detection of the rotational position of the winding core member 132, is provided at one end portion of the winding core member 132 (i.e., at the side of one of the guide rails 134). By detecting the position of the phase plate 172, the rotation of the winding core member 132 and the advancing of the photosensitive material 14 being wound around the outer periphery thereof can be synchronized. In this way, the leading end portion of the photosensitive material 14 can first stick to the sticking portion 170.

Operation of the present embodiment will be described hereinafter.

In the image recording apparatus 10 having the above structure, the nip roller 18 is operated so that the photosensitive material 14 is drawn out by the nip roller 18. When the photosensitive material 14 is drawn out to a predetermined length, the cutter 20 is operated so that the photosensitive material 14 is cut to the predetermined length. The cut photosensitive material 14 is transported to the exposure section 34 with its photosensitive (exposure) surface facing towards the left side in FIG. 10. Then, the photosensitive material 14 passes through the exposure section 34, and simultaneously, the laser beam emitting section 36 is operated.

In the laser beam emitting section 36, a laser beam based on image data irradiates the photosensitive material 14 positioned in the exposure section 34. As a result, the photosensitive material 14 is scanned and exposed such that an image based on the image data is formed thereon.

Then, the exposed photosensitive material 14 is transported to the water applying section 38. In the water applying section 38, water is jetted from the jet tank 40 towards the photosensitive material 14 which is being conveyed, such that water is applied onto the photosensitive material 14. Thereafter, the photosensitive material 14, to which water has been applied, is delivered in between the pair of endless belts 60 and 62 of the thermal development transfer section 58 by the transport rollers 32.

On the other hand, as the photosensitive material 14 is scanned and exposed, the image receiving material 42 is drawn out of the image receiving material magazine 44 and transported by the nip roller 46. When the image receiving material 42 is drawn out to a predetermined length, the cutter 48 is operated so that the image receiving material 42 is cut to the predetermined length.

After the cutter 48 is operated, the cut image receiving material 42 is transported by the transport rollers 50, 52, 54 and 56 while being guided by the guide plates. When the leading end portion of the image receiving material 42 is nipped by the transport rollers 56, the image receiving material 42 is brought into a standby state just before the thermal development transfer section 58.

Then, as the photosensitive material 14 is delivered in between the pair of endless belts 60 and 62 by the transport rollers 32 as mentioned above, the conveying of the image receiving material 42 is restarted so that the image receiving material 42 is fed in between the pair of endless belts 60 and 62 integrally with the photosensitive material 14.

As a result, the photosensitive material 14 is overlapped with the image receiving material 42, and the overlapped photosensitive material 14 and image receiving material 42 are heated by the heating plate 66 while being sandwiched and conveyed. As a result, the image, which was exposed on the photosensitive material 14, is transferred onto the image receiving material 42 so that the image is formed on the image receiving material 42.

Further, when the photosensitive material 14 and the image recording material 42 are discharged from the pair of endless belts 60 and 62, the leading end portion of the photosensitive material 14, which precedes the image receiving material 42 by a predetermined length, is engaged with the peeling claw 68, and the leading end portion of the photosensitive material 14 is peeled from the image receiving material 42. Further, the photosensitive material 14 is transported by the photosensitive material discharge roller 70 so as to be collected within the collecting apparatus 90. On the other hand, the image receiving material 42, which was separated from the photosensitive material 14, is transported by the image receiving material discharge rollers 72, 74, 76, 78 and 80 so as to be discharged onto the tray 82.

In the collecting apparatus 90 in which the photosensitive materials 14 are collected, the photosensitive material 14, which was peeled from the image receiving material 42 by the peeling claw 68 and fed out by the photosensitive material discharge roller 70, is guided and fed between the endless belt 114 and the winding core 130 by the guide roller 116. As a result, the photosensitive material 14 is successively wound around the winding core 130 while being sandwiched between the endless belt 114 and the winding core 130.

In the collecting apparatus 90, the photosensitive material 14 to be wound has had water applied thereto and was heated, and thus is tacky, so that it can be wound around the winding core 130 securely. The collecting apparatus 90 is particularly effective for cases in which sheets, which are tacky and thus are hard to collect by stacking them one on top of the other, are collected.

In this case, at the winding core 130 of the collecting apparatus 90, by detecting the position of the phase plate 172, which is provided at the winding core member 132 for detection of the rotational position of the winding core member 132, the rotation of the winding core member 132 and the advancing of the photosensitive material 14 can be synchronized such that the leading end portion of the photosensitive material 14 first sticks to the sticking portion 170. Here, because the surface roughness of the sticking portion 170 is $R_z=0.1\mu$ or less (i.e., because the surface of the sticking portion 170 is formed as a mirror finished surface), the leading end portion of the photosensitive material 14 sticks more easily to the sticking portion 170, such that the photosensitive materials 14 can be reliably wound around the outer periphery of the winding core member 132.

Further, when the photosensitive materials 14 are wound in layers successively around the outer periphery of the winding core member 132 of the winding core 130, the stopper rubbers 160 or the stopper rubbers 162 engage with both transverse direction edges of the photosensitive materials 14, and accordingly, deviative winding of the photosensitive materials 14 along the axial direction of the winding core member 132 is prevented. Therefore, the photosensitive materials 14 can be wound around the outer periphery of the winding core member 132 (first main body 132A, second main body 132B and third main body 132C) more uniformly (efficiently).

Further, in the winding core 130, as shown in FIG. 5, the projections 150 of the winding core member 132 (first main body 132A, second main body 132B and third main body 132C) are positioned in the holding portions 148 of the cams 140 (cam grooves 146), and this state is maintained by the spring 152 and the spring 153. Therefore, the first main body 132A, the second main body 132B and the third main body 132C are in a state in which they are separated from each other, and movement thereof in directions of approaching each other (namely, in directions of approaching the supporting shaft 142) is limited. For this reason, the diameter of the winding core 130 (winding core member 132) does not decrease inadvertently.

When the wound diameter becomes larger by winding the photosensitive materials 14 around the winding core 130 (winding core member 132), the roller 108 forming the buffer portion 126 of the endless belt 114 moves (shifts) toward the right in FIG. 11 along the guide groove 122 so that the apparent increase in the trained length of the endless belt 114 due to the increase in the wound diameter is absorbed.

Since the photosensitive materials 14 are wound and collected around the winding core 130 (winding core member 132), even if photosensitive materials 14 having various sizes are used, they can be collected efficiently. Moreover, since the photosensitive materials 14 are collected while being sandwiched between the winding core 130 (winding member 132) and the endless belt 114, the photosensitive materials 14 do not curl. For this reason, there is no need for countermeasures such as providing a presser plate for preventing curling, or corrugating the photosensitive materials 14 so that stiffness is improved, or the like. As a result, the structure is simple and the cost is low.

Figure 13:
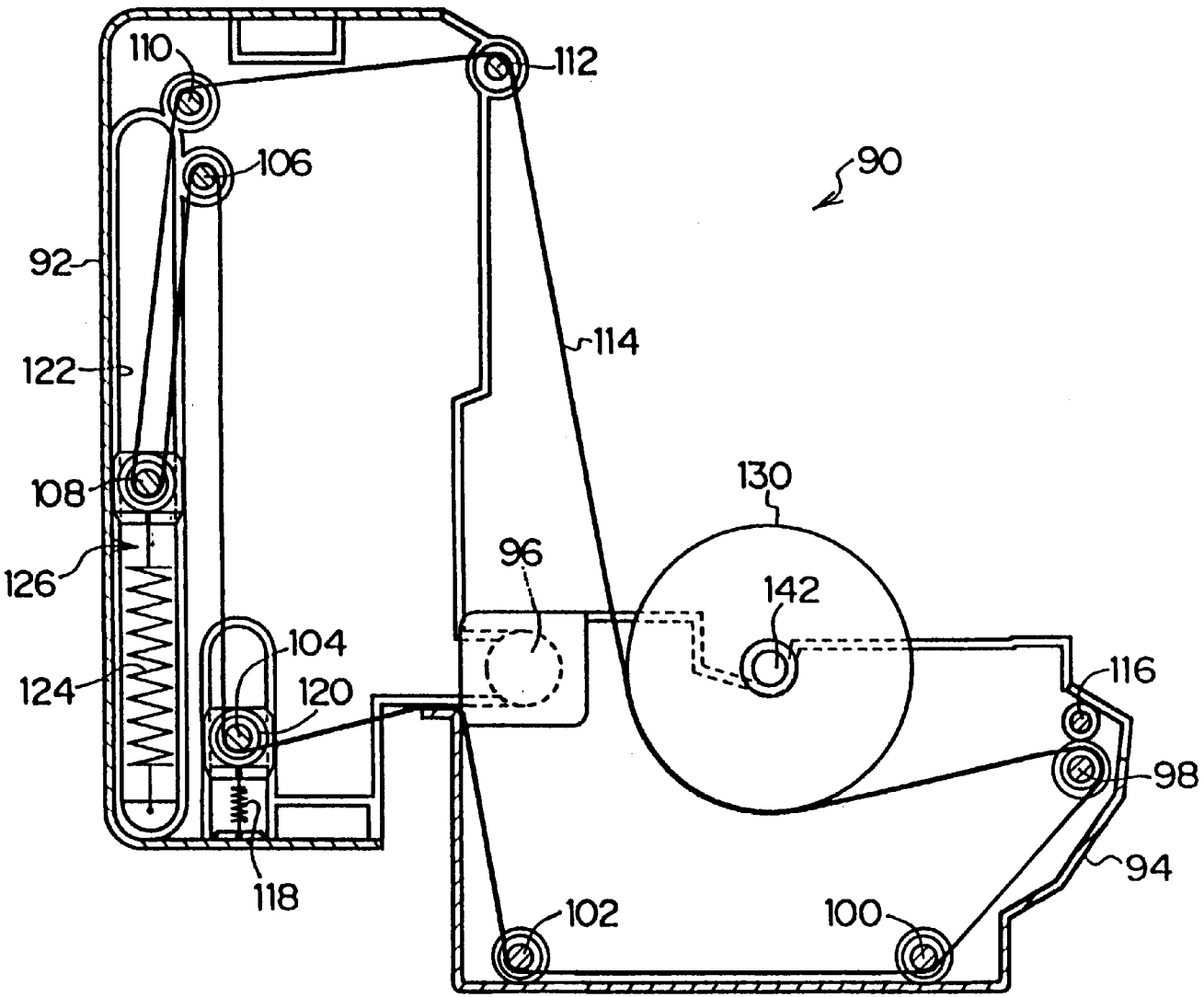
FIG. 13 is a sectional view showing the structure of the collecting apparatus to which the winding core according to the embodiment of the present invention is applied, wherein the collecting apparatus is in an open state.

In addition, in the collecting apparatus 90, when the upper main body 92 is pivoted about the supporting shaft 96 with respect to the lower main body 94 such that the apparatus is opened, as shown in FIG. 13, the winding core 130 is exposed. Therefore, the photosensitive materials 14 collected therein can be easily taken out, and maintenance is easy.

Further, since the collecting apparatus 90 is formed as a unit by the upper main body 92 and the lower main body 94 which support the winding core 130, the plural rollers 98, and the like, the collecting apparatus 90 can also be applied to apparatuses other than the image recording apparatus 10. Moreover, even sheet materials other than the photosensitive materials 14, for example, sheet materials which are tacking, can be collected reliably, such that the range of application is greatly broadened.

Furthermore, the winding core 130 of the collecting apparatus 90 is formed by the first main body 132A, the second main body 132B and the third main body 132C which are three divisional portions of the winding core member 132, and the outer diameter of the winding core 130 can be decreased. Therefore, after the photosensitive materials 14 are wound and collected, the winding core 130 can be separated (pulled out) from the photosensitive materials 14 easily.

Namely, when, after the photosensitive materials 14 are wound in layers around the winding core 130, the winding core 130 is separated (pulled out) from the photosensitive materials 14 wound in layers. Then first, the winding core 130 together with the photosensitive materials 14 is taken out of the lower main body 94. Next, the supporting shaft 142, namely, the cams 140 are rotated by operating the handle 154. When the cams 140 are rotated together with the supporting shaft 142, the inner peripheral walls of the cam grooves 146 are engaged with the projections 150, and the projections 150, namely, the first main body 132A, the second main body 132B and the third main body 132C of the winding core member 132, are pulled in in directions of approaching each other in the radial direction (namely, towards the supporting shaft 142) so that the outside diameter of the winding core member 132 (winding core 130) is decreased (the state of FIG. 6). As a result, the winding core 130 can be easily separated (pulled out) from the photosensitive materials 14 which are wound in layers closely thereon.

Further, in this case, at the winding core 130, the surface of the winding core member 132 other than at the sticking portion 170 is formed to have a surface roughness of $R_z=10\mu$ or more. Thus, at the regions other than the region at which the sticking portion 170 is formed, it is difficult for the photosensitive materials 14 to closely contact the winding core member 132. Accordingly, the photosensitive materials 14 can easily be peeled from the surface of the winding core member 132, and the winding core 130 can be more reliably separated from the photosensitive materials 14 wound closely thereon.

In addition, in the winding core 130, in the state in which the outside diameter of the winding core member 132 is decreased, namely, when the outside diameter of the winding core 130 is decreased in order to separate (pull out) the winding core 130 from the photosensitive materials 14 after the photosensitive materials 14 are wound in layers around the winding core 130 (the outer periphery of the winding core member 132), the plural peeling pins 166 project outward from the surface (through-holes 156) of the winding core member 132 (first main body 132A, second main body 132B and the third main body 132C). For this reason, even if the outer diameter of the winding core 130 has been decreased and the photosensitive materials 14 attempt to closely contact the surface of the winding core member 132, the photosensitive materials 14 can be peeled forcibly from the surface of the winding core member 132 (first main body 132A, second main body 132B and third main body 132C), and the winding core 130 can be more reliably separated from the photosensitive materials 14 wound closely thereon.

As described above, the winding core 130 according to the present embodiment can not only wind and collect sheet materials such as the photosensitive materials 14, but also, can be easily separated from the wound photosensitive materials 14 without effort and time.

In addition, since the winding core member 132 is formed by the first main body 132A, the second main body 132B and the third main body 132C which are three parts divided along the axial direction, the entire periphery of the winding core 130 can be increased and decreased to a large degree with respect to wound sheet materials such as the photosensitive materials 14, so that the winding core 130 can be reliably separated from the sheet materials wound in layers closely thereon.

Further, when the cams 140 are rotated by operating the handle 154, the first main body 132A, the second main body 132B and the third main body 132C of the winding core member 132 approach from each other in the radial direction so that the outside diameter of the winding core 130 can be decreased. Moreover, when the handle 154 is released, the outer diameter of the winding core 130 increases automatically due to the forces of the spring 152 and the spring 153. For this reason, the outer diameter can be increased and decreased by an extremely easy operation, so that effort and time are not required.

In the above-described embodiment, the winding core member 132 is divided into three parts so as to be formed by the first main body 132A, the second main body 132B and the third main body 132C. However, the present invention is not limited to the same, and the winding core member 132 may be divided into four or more parts.

The above-described embodiment is an example in which the photosensitive materials 14 cut to respective sizes are used as plural sheet materials. However, the present invention is not limited to the same, and may of course be applied to a continuous material, for example, a continuous rolled material.

Further, the above describes an example in which the peeling pins 166 are used as the peeling members. However, the peeling members are not limited to such pin-shaped peeling pins 166, and, for example, pipe-shaped peeling pieces, plate-spring-shaped peeling springs, or the like may be used.

In the above-described embodiment, the winding core 130 is divided into three portions along the axial direction so as to be formed by the first main body 132A, the second main body 132B, and the third main body 132C. The diameters of the axial direction end portions of the winding core member 132 (the first main body 132A, the second main body 132B, and the third main body 132C) increase and decrease to the same extent (equally) However, the present invention is not limited to the same, and for example, it is possible to have the diameter of only one axial direction end portion of the winding core member 132 (the first main body 132A, the second main body 132B, and the third main body 132C) increase and decrease (i.e., such that the winding core member 132 becomes conical when the diameter of the one axial direction end portion thereof is decreased).

Moreover, in the above-described embodiment, the first main body 132A, the second main body 132B, and the third main body 132C which form the winding core member 132 of the winding core 130 have been divided into three at positions which are parallel along the axis of the winding core member 132 (the supporting shaft 142). However, the positions at which the first main body 132A, the second main body 132B, and the third main body 132C are divided are not limited to the same.

For example, the positions at which the first main body 132A, the second main body 132B, and the third main body 132C are divided may be set spirally along the periphery of the winding core member 132. Alternatively, the positions at which the first main body 132A, the second main body 132B, and the third main body 132C are divided may be set so as to be curved along the periphery of the winding core member 132 (i.e., not parallel to the supporting shaft 142).

As described above, the sheet material winding core according to the present invention can not only wind and collect sheet materials such as photosensitive materials and image receiving materials, but also, can be separated easily from the wound sheet materials without effort and time, thereby realizing the winding core by a simple structure.

What is claimed is:

1. A sheet material winding core, comprising:

a winding core member which is formed substantially cylindrically on the whole, and is formed by being divided along an axial direction into at least three main bodies, the main bodies being able to approach and move away from each other in a radial direction, said winding core member winding a sheet material around an outer periphery thereof; and means for increasing/decreasing an outer diameter provided within said winding core member, said increasing/decreasing means allowing the main bodies to approach and move away from each other in the radial direction so as to increase and decrease an outer diameter of said winding core member.

2. A sheet material winding core according to claim 1, further comprising a plurality of peeling members which are provided within said winding core member and project outward from surfaces of the main bodies in a state in which the outer diameter of said winding core member is decreased.

3. A sheet material winding core according to claim 2, further comprising stopper members for preventing deviative winding of the sheet material along the axial direction of said winding core member, said stopper members being mounted to the surfaces of said main bodies so as to correspond to transverse direction edges of the sheet material wound around the outer periphery of said winding core member.

4. A sheet material winding core according to claim 3, wherein said stopper members are at least two of stopper pieces, each of said pairs of stopper pieces being disposed on respectively different lines which run along a peripheral direction of said winding core member.

5. A sheet material winding core according to claim 4, further comprising a sticking portion provided at a surface of said main bodies so as to correspond to a leading end portion of a sheet material to be wound around the outer periphery of said winding core member, the leading end portion of the sheet material first sticking to said sticking portion.

6. A sheet material winding core according to claim 5, wherein a dimension of said sticking portion along a peripheral direction of said winding core member is in a range from 1 mm to 40 mm.

7. A sheet material winding core according to claim 6, wherein a surface of said sticking portion is formed to have a surface roughness of not greater than $R_z=0.1\mu$, and surfaces of said main bodies other than at said sticking portion are formed to have a surface roughness of at least $R_z=10\mu$.

8. A sheet material winding core according to claim 5, wherein a phase plate for detection of a rotational position of said winding core member is provided at said winding core member, and due to detection of a position of said phase plate, rotation of said winding core member and advancing of the sheet material are synchronized such that the leading end portion of the sheet material first sticks to said sticking portion.

9. A sheet material winding core according to claim 5, wherein a surface of said sticking portion is formed to have a surface roughness of not greater than $R_z=0.1\mu$, and surfaces of said main bodies other than at said sticking portion are formed to have a surface roughness of at least $R_z=10\mu$.

10. A sheet material winding core according to claim 3, further comprising a sticking portion provided at a surface of said main bodies so as to correspond to a leading end portion of a sheet material to be wound around the outer periphery of said winding core member, the leading end portion of the sheet material first sticking to said sticking portion.

11. A sheet material winding core according to claim 2, further comprising a sticking portion provided at a surface of said main bodies so as to correspond to a leading end portion of a sheet material to be wound around the outer periphery of said winding core member, the leading end portion of the sheet material first sticking to said sticking portion.

12. A sheet material winding core according to claim 1, further comprising a sticking portion provided at a surface of said main bodies so as to correspond to a leading end portion of a sheet material to be wound around the outer periphery of said winding core member, the leading end portion of the sheet material first sticking to said sticking portion.

13. A sheet material winding core, comprising:

a winding core member which is formed substantially cylindrically on the whole, and is formed by being divided along an axial direction into at least three main bodies, the main bodies being able to approach and move away from each other in a radial direction, said winding core member winding a sheet material around an outer periphery thereof; and an outer diameter increasing/decreasing mechanism provided within said winding core member, said mechanism allowing the main bodies to approach and move away from each other in the radial direction so as to increase and decrease an outer diameter of said winding core member;

a plurality of peeling members which are provided within said winding core member and project outward from surfaces of the main bodies in a state in which the outer diameter of said winding core member is decreased;

wherein said outer diameter increasing/decreasing mechanism includes:

a pair of substantially disk-shaped cams which are fixed to vicinities of both axial direction ends of a supporting shaft provided in a center portion in said winding core member and which have a plurality of cam grooves notched in a supporting shaft direction;

projections which project from both axial direction ends of the main bodies and engage with the cam grooves;

a first coil spring whose one end is anchored to one of the cams and whose other end is anchored to one of the main bodies;

a second coil spring whose one end is anchored to said one of the cams and whose other end is anchored to one of the other main bodies;

a pair of guide members which are mounted to the supporting shaft at supporting shaft axial direction outer sides of the cams so as to be rotatable relatively to the supporting shaft, the guide members engaging with the main bodies; and a handle which is mounted to one end of the supporting shaft and is operated to rotate the cams.

14. A sheet material winding core according to claim 13, further comprising a sticking portion provided at a surface of said main bodies so as to correspond to a leading end portion of a sheet material to be wound around the outer periphery of said winding core member, the leading end portion of the sheet material first sticking to said sticking portion.

15. A sheet material winding core according to claim 14, wherein a phase plate for detection of a rotational position of said winding core member is provided at said winding core member, and due to detection of a position of said phase plate, rotation of said winding core member and advancing of the sheet material are synchronized such that the leading end portion of the sheet material first sticks to said sticking portion.

16. A sheet material winding core according to claim 14, wherein a surface of said sticking portion is formed to have a surface roughness of not greater than $R_z=0.1\mu$, and surfaces of said main bodies other than at said sticking portion are formed to have a surface roughness of at least $R_z=10\mu$.

17. A sheet material winding core according to claim 16, wherein the first coil spring and the second coil spring urge said main bodies in directions of moving away from each other.

18. A sheet material winding core according to claim 14, wherein the first coil spring and the second coil spring urge said main bodies in directions of moving away from each other.

19. A sheet material winding core according to claim 14, wherein said main bodies are moved in the direction of the supporting shaft by turning the handle against the urging forces of the first coil spring and the second coil spring, so that the outer diameter of said winding core member is decreased.

20. A sheet material winding core according to claim 13, wherein said main bodies are moved in the direction of the supporting shaft by turning handle against urging forces of the first coil spring and the second coil spring, so that the outer diameter of said winding core member is decreased.

21. A sheet material winding core, comprising:

a winding core member which is formed substantially cylindrically on the whole, and is formed by being divided along an axial direction into at least three main bodies, the main bodies being able to approach and move away from each other in a radial direction, said winding core member winding a sheet material around an outer periphery thereof; and an outer diameter increasing/decreasing mechanism provided within said winding core member, said mechanism allowing the main bodies to approach and move away from each other in the radial direction so as to increase and decrease an outer diameter of said winding core member;

wherein said outer diameter increasing/decreasing mechanism includes:

a pair of substantially disk-shaped cams which are fixed to vicinities of both axial direction ends of a supporting shaft provided in a center portion in said winding core member and which have a plurality of cam grooves notched in a supporting shaft direction;

projections which project from both axial direction ends of the main bodies and engage with the cam grooves;

a first coil spring whose one end is anchored to one of the cams and whose other end is anchored to one of the main bodies;

a second coil spring whose one end is anchored to said one of the cams and whose other end is anchored to one of the other main bodies;

a pair of guide members which are mounted to the supporting shaft at supporting shaft axial direction outer sides of the cams so as to be rotatable relatively to the supporting shaft, the guide members engaging with the main bodies; and a handle which is mounted to one end of the supporting shaft and is operated to rotate the cams.

22. A sheet material winding core, comprising:

a winding core member which is formed substantially cylindrically on the whole, and is formed by being divided along an axial direction into at least three main bodies, the main bodies being able to approach and move away from each other in a radial direction, said winding core member winding a sheet material around an outer periphery thereof;

an outer diameter increasing/decreasing mechanism provided within said winding core member, said mechanism allowing the main bodies to approach and move away from each other in the radial direction so as to increase and decrease an outer diameter of said winding core member;

a plurality of peeling members which are provided within said winding core member and project outward from surfaces of the main bodies in a state in which the outer diameter of said winding core member is decreased;

stopper members for preventing deviative winding of the sheet material along the axial direction of said winding core member, said stopper members being mounted to the surfaces of said main bodies so as to correspond to transverse direction edges of the sheet material wound around the outer periphery of said winding core member;

wherein said stopper members are at least two pairs of stopper pieces, each of said pairs of stopper pieces being disposed on respectively different lines which run along a peripheral direction of said winding core member; and a sticking portion provided at a surface of said main bodies so as to correspond to a leading end portion of a sheet material to be wound around the outer periphery of said winding core member, the leading end portion of the sheet material first sticking to said sticking portion;

wherein a dimension of said sticking portion along a peripheral direction of said winding core member is in a range from 1 mm to 40 mm.

23. A sheet material winding core, comprising:

a winding core member which is formed substantially cylindrically on the whole, and is formed by being divided along an axial direction into at least three main bodies, the main bodies being able to approach and move away from each other in a radial direction, said winding core member winding a sheet material around an outer periphery thereof;

an outer diameter increasing/decreasing mechanism provided within said winding core member, said mechanism allowing the main bodies to approach and move away from each other in the radial direction so as to increase and decrease an outer diameter of said winding core member;

a plurality of peeling members which are provided within said winding core member and project outward from surfaces of the main bodies in a state in which the outer diameter of said winding core member is decreased;

stopper members for preventing deviative winding of the sheet material along the axial direction of said winding core member, said stopper members being mounted to the surfaces of said main bodies so as to correspond to transverse direction edges of the sheet material wound around the outer periphery of said winding core member;

wherein said stopper members are at least two pairs of stopper pieces, each of said pairs of stopper pieces being disposed on respectively different lines which run along a peripheral direction of said winding core member; and a sticking portion provided at a surface of said main bodies so as to correspond to a leading end portion of a sheet material to be wound around the outer periphery of said winding core member, the leading end portion of the sheet material first sticking to said sticking portion;

wherein a phase plate for detection of a rotational position of said winding core member is provided at said winding core member, and due to detection of a position of said phase plate, rotation of said winding core member and advancing of the sheet material are synchronized such that the leading end portion of the sheet material first sticks to said sticking portion.

24. A sheet material winding core, comprising:

a winding core member which is formed substantially cylindrically on the whole, and is formed by being divided along an axial direction into at least three main bodies, the main bodies being able to approach and move away from each other in a radial direction, said winding core member winding a sheet material around an outer periphery thereof;

an outer diameter increasing/decreasing mechanism provided within said winding core member, said mechanism allowing the main bodies to approach and move away from each other in the radial direction so as to increase and decrease an outer diameter of said winding core member;

a plurality of peeling members which are provided within said winding core member and project outward from surfaces of the main bodies in a state in which the outer diameter of said winding core member is decreased;

stopper members for preventing deviative winding of the sheet material along the axial direction of said winding core member, said stopper members being mounted to the surfaces of said main bodies so as to correspond to transverse direction edges of the sheet material wound around the outer periphery of said winding core member;

wherein said stopper members are at least two pairs of stopper pieces, each of said pairs of stopper pieces being disposed on respectively different lines which run along a peripheral direction of said winding core member; and a sticking portion provided at a surface of said main bodies so as to correspond to a leading end portion of a sheet material to be wound around the outer periphery of said winding core member, the leading end portion of the sheet material first sticking to said sticking portion;

wherein a surface of said sticking portion is formed to have a surface roughness of not greater than $R_z=0.1\mu$, and surfaces of said main bodies other than at said sticking portion are formed to have a surface roughness of at least $R_z=10\mu$.

* * * * *